US010641041B2

(12) United States Patent
Moss et al.

(10) Patent No.: US 10,641,041 B2
(45) **Date of Patent: *May 5, 2020**

(54) ELEVATED WORKING PLATFORM AND RELATED METHODS

(71) Applicant: Wing Enterprises, Incorporated, Springville, UT (US)

(72) Inventors: N. Ryan Moss, Mapleton, UT (US); Darius S. Penrod, Elberta, UT (US); Brian Russell, Saratoga Springs, UT (US); Sean Peterson, Payson, UT (US); Gary Joans, Springville, UT (US)

(73) Assignee: WING ENTERPRISES, INCORPORATED, Springville, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/208,420

(22) Filed: Dec. 3, 2018

(65) Prior Publication Data

US 2019/0100964 A1 Apr. 4, 2019

Related U.S. Application Data

(63) Continuation of application No. 15/587,765, filed on May 5, 2017, now Pat. No. 10,145,176, which is a (Continued)

(51) Int. Cl.

*A47L 3/02* (2006.01)
*E06C 7/18* (2006.01)

(Continued)

(52) U.S. Cl.

CPC ..... *E06C 7/182* (2013.01); *E06C 1/393* (2013.01); *E06C 1/397* (2013.01); *E06C 7/185* (2013.01); *E06C 7/423* (2013.01)

(58) Field of Classification Search

CPC ..... E06C 7/182; E06C 7/185; E06C 7/397; E06C 7/393

(Continued)

(56) References Cited

U.S. PATENT DOCUMENTS 257,463 A 5/1882 Boyd
1,028,874 A 6/1912 Gronek (Continued)

FOREIGN PATENT DOCUMENTS

EP 1921249 A1 5/2008
EP 2013128 A1 3/2009

(Continued)

*Primary Examiner* — Jerry E Redman

(74) *Attorney, Agent, or Firm* — Dorsey & Whitney LLP

(57) ABSTRACT

Elevated work platforms, as well as associated methods, are provided. In one particular embodiment, an elevated platform apparatus is provided comprising a first rail assembly having a pair of rails coupled with a plurality of rungs, a second rail assembly hingedly coupled with the first rail assembly, a platform configured to rest upon a portion of the first rail assembly and the second rails assembly and a cage associated with the platform. The cage may include at least one bar and at least one gate, the at least one gate being configured to swing in a first direction upon a user stepping on to the platform from the first rail assembly, and then swing back to a closed position after the user is standing on the platform. The at least one gate is also limited from being displaced in a second direction, opposite the first direction, beyond the closed position.

16 Claims, 15 Drawing Sheets

Related U.S. Application Data continuation of application No. 13/748,263, filed on Jan. 23, 2013, now Pat. No. 9,663,989.

(60) Provisional application No. 61/589,790, filed on Jan. 23, 2012.

(51) Int. Cl.
*E06C 1/393* (2006.01)
*E06C 1/397* (2006.01)
*E06C 7/42* (2006.01)

(58) Field of Classification Search
USPC ..... 182/113
See application file for complete search history.

(56) References Cited

U.S. PATENT DOCUMENTS

| | | | | |
|---|---|---|---|---|
| 3,536,159 | A | 10/1970 | Kramer | |
| 3,610,367 | A | 10/1971 | Atchey | |
| 4,182,431 | A | 1/1980 | Wing et al. | |
| 5,024,291 | A | 6/1991 | Price | |
| 5,080,192 | A | 1/1992 | Kerr | |
| 5,590,739 | A | 1/1997 | High et al. | |
| 5,653,306 | A | 8/1997 | Bendickson et al. | |
| 6,102,156 | A | 8/2000 | Lipniarski | |
| 6,422,340 | B1 | 7/2002 | Grundler | |
| 6,799,660 | B1 | 10/2004 | Crawford | |
| 6,863,155 | B2 | 3/2005 | Wyse et al. | |
| 7,086,499 | B2 | 8/2006 | Moss | |
| 7,104,361 | B2 | 9/2006 | Walsh | |
| 9,016,434 | B2 | 4/2015 | Moss et al. | |
| 9,663,989 | B2 * | 5/2017 | Moss | E06C 1/393 |
| 9,745,777 | B2 | 8/2017 | Whiting et al. | |
| 10,100,576 | B1 * | 10/2018 | Dimovski | E06C 1/34 |
| 10,370,816 | B2 * | 8/2019 | Whiting | |
| 2005/0189173 | A1 | 9/2005 | Becker | |
| 2005/0220917 | A1 | 10/2005 | Pierik et al. | |
| 2007/0151801 | A1 | 7/2007 | Talley | |
| 2008/0060874 | A1 * | 3/2008 | Lair | E06C 1/12 182/77 |
| 2009/0229918 | A1 | 9/2009 | Moss et al. | |
| 2010/0031573 | A1 * | 2/2010 | Whiting | E05B 47/02 49/31 |
| 2011/0011674 | A1 | 1/2011 | Kim | |
| 2011/0017967 | A1 * | 1/2011 | Whiting | E04D 13/0335 256/59 |
| 2012/0073902 | A1 | 3/2012 | Honeycutt | |
| 2012/0186066 | A1 | 7/2012 | Chilton | |
| 2012/0211305 | A1 | 8/2012 | Moss et al. | |
| 2013/0186710 | A1 | 7/2013 | Moss et al. | |
| 2016/0138338 | A1 | 5/2016 | Olson | |
| 2017/0226803 | A1 | 8/2017 | Russell et al. | |
| 2017/0321452 | A1 | 11/2017 | Whiting et al. | |
| 2018/0044986 | A1 | 2/2018 | Cook | |

FOREIGN PATENT DOCUMENTS

| | | | |
|---|---|---|---|
| EP | 2949541 | A1 | 12/2015 |
| EP | 3015640 | A1 | 5/2016 |
| GB | 2419373 | A | 4/2006 |
| WO | 2010151892 | A1 | 12/2010 |

* cited by examiner

ELEVATED WORKING PLATFORM AND RELATED METHODS

CROSS-REFERENCE TO RELATED APPLICATION

This application is a continuation of U.S. application Ser. No. 15/587,765, filed May 5, 2017, now U.S. Pat. No. 10,145,176, and entitled ELEVATED WORKING PLATFORM AND RELATED METHODS, which is a continuation of U.S. application Ser. No. 13/748,263, filed Jan. 23, 2013, now U.S. Pat. No. 9,663,989, and entitled ELEVATED WORKING PLATFORM AND RELATED METHODS, which application claims the benefit of U.S. Provisional Patent Application No. 61/589,790 entitled PLATFORM LADDER AND RELATED METHODS, filed on Jan. 23, 2012, the disclosures of which are incorporated by reference herein in their entireties.

TECHNICAL FIELD

The present invention relates generally to elevated working platforms related methods.

BACKGROUND

Ladders are one type of apparatus conventionally used to provide a user with improved access to elevated locations that might otherwise be difficult to reach. One of the advantages of ladders is their convenience. Ladders are easily transported from one location to another, generally easy to set up and use at a specific location, and easy to store when not in use. Ladders come in many sizes and configurations, such as straight ladders, extension ladders, stepladders, and combination step and extension ladders. So-called combination ladders may incorporate, in a single ladder, many of the benefits of multiple ladder designs.

In an effort to provide more secure, safe and stable access to elevated locations, users often employ various accessories. For example, planks or other structures are sometimes combined with two or more ladders to act as a platform or scaffolding. In one particular example, so-called ladder jacks are often utilized in conjunction with a pair of ladders to provide a support for one or more wooden planks (e.g., 2 inch×10 inch planks or 2 inch×12 inch planks). Such a configuration enables a user to work on an elevated surface that exhibits a larger support surface area than that of the rung of a ladder and, thus, enables the user to work in a larger area without having to move a ladder multiple tines. In another example, an attachment sometimes referred to as a work platform may be coupled to one or more rungs of a ladder in an effort to provide more surface area for the user to stand on, improving their stability and comfort. However, breaking down or disassembling such a configuration, moving all of the components and then setting them up again can be time consuming and require considerable effort. Additionally, there are typically no safety constraints used in such a configuration, making the use of planks a potential safety concern.

It is becoming increasingly common to require users to "tie off" or otherwise secure themselves when using a ladder or other elevating apparatus on a job site. Such a requirement may be instituted by a property owner, by an employer, or by a governmental body such as OSHA (Occupational Safety and Health Administration) to reduce the risk of injury from a fall. However, users of ladders (or other elevated support structures) sometimes find such requirements to be a nuisance and some may even try to avoid such requirements. At a minimum, users of a ladder will typically find that such requirements take additional time, making the worker less efficient at completing their task, even if they are safer while working.

It is also known that many users will often climb higher on a ladder than is recommended for the specific ladder—sometimes to the highest rung of a stepladder or even on the top cap of a stepladder—even though explicit warnings are provided by the manufacturer of the ladder against such behavior. Climbing beyond the highest recommended rung can make the ladder unstable. Additionally, the user may become unstable when climbing beyond a recommended height because, for example, they may not have any additional structure to lean against or grasp with a free hand while standing at or near the very top of the ladder.

As such, the industry is continually looking for ways to improve the experience of using ladders and elevated platforms and to provide the users of such apparatuses with more efficient, effective, safe and comfortable experiences.

BRIEF SUMMARY OF THE INVENTION

In accordance with the present invention, various embodiments of an elevated work platform, as well as associated methods, are provided. The elevated platform may provide a relatively large surface area for a user to stand on while working at an elevated height while also providing a safe working environment without the need to continually tie-off or wear a harness during the use of the apparatus.

In accordance with one embodiment, an elevated platform apparatus is provided comprising a first rail assembly having a pair of rails coupled with a plurality of rungs, a second rail assembly hingedly coupled with the first rail assembly, a platform configured to rest upon a portion of the first rail assembly and the second rails assembly and a cage associated with the platform. The cage includes at least one bar and at least one gate, the at least one gate being configured to swing in a first direction upon a user stepping on to the platform from the first rail assembly, and swing back to a closed position after the user is standing on the platform, the at least one gate also being limited from being displaced in a second direction, opposite the first direction, beyond the closed position.

In one embodiment, the platform is pivotally coupled with the first rail assembly and in selective locking engagement with the second rail assembly.

In one embodiment, the at least one gate includes a pair of gates adjacent one another. Each gate of the pair may include, according to one particular embodiment, a pivoting coupling member having an inclined engagement surface, wherein the inclined engagement surface, in conjunction with the weight of the gate, biases the gate to the closed position.

In one embodiment, the first rail assembly includes an outer rail assembly and an inner rail assembly slidingly coupled with the first rail assembly. One or more adjustment mechanisms may be used to selectively lock the inner rail assembly at a specified location relative to outer rail assembly.

In certain embodiments, a pulley system may be associated with the first assembly. For example, a pulley system may include a tension line having a first, free end and a second end coupled with the outer rail assembly, the tension line being fed through a first pulley coupled to the outer rail assembly and a second pulley coupled with the inner rail assembly.

As with the first rail assembly, according to one embodiment, the second rail assembly includes an outer rail assembly and an inner rail assembly slidingly coupled with the first rail assembly. Again, one or more adjustment mechanisms may be used to selectively lock the inner rail assembly of the second assembly at a specified location relative to outer rail assembly of the second assembly. Another pulley system may be associated with the second assembly.

In one embodiment, a barrier member may be positioned on an interior surface of the outer rail assembly at a location adjacent the at least one adjusting mechanism. The barrier member may be configured and located to prevent potential injury to a user's hands or fingers.

In one embodiment, where inner and outer rail assemblies are used, rails of the inner rail assembly are disposed within cross-sectional cavities of associated rails of the outer rail assembly. The rails of the outer rail assembly each include a bracket at their upper end substantially circumscribing the rails of the outer rail assembly as well as the rails of the inner rail assembly, with the bracket defining a slot located along a surface of the rails of the inner rail assembly.

In certain embodiments, at least one pair of wheels coupled with the apparatus. In one specific embodiment the at least one pair of wheels includes: a first pair of wheels coupled with at least one of the first assembly and the second assembly at a fixed location a second pair of wheels coupled with the first assembly, the second pair of wheels including at least one retraction mechanism; and a third pair of wheels coupled with the second assembly, the third pair of wheels including at least one retraction mechanism. In one embodiment, each of the at least one retraction mechanism associated with the second pair of wheels and the at least one retraction mechanism associated with third pair of wheels includes a cam cylinder, a push rod, a cam follower and at least one biasing member.

In one embodiment, a flexible barrier disposed at least partially about the cage. Such a flexible barrier may include netting or a mesh material. In one particular embodiment, the at least one bar of the cage includes a first bar at a first elevation relative to the platform and a second bar and a second, higher elevation relative to the platform, and the flexible barrier extends between the platform and the first bar and substantially circumscribes the platform except for the location of the pair of gates.

In one particular embodiment, the second assembly includes a pair of rails and a plurality of rungs, and the cage is defined to include at least one additional gate, wherein the at least one additional gate is configured to be displaced from a closed position upon a user stepping on to the platform from the second rail assembly, and return to a closed position after the user is standing on the platform. In certain embodiments, the at least one additional gate includes a pair of gates positioned adjacent to each other.

In accordance with one embodiment, at least one stabilizer coupled with at least one of the first rail assembly and the second rail assembly.

Features, aspects and acts of any of the various embodiments described herein may be combined, without limitation, with other described embodiments.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
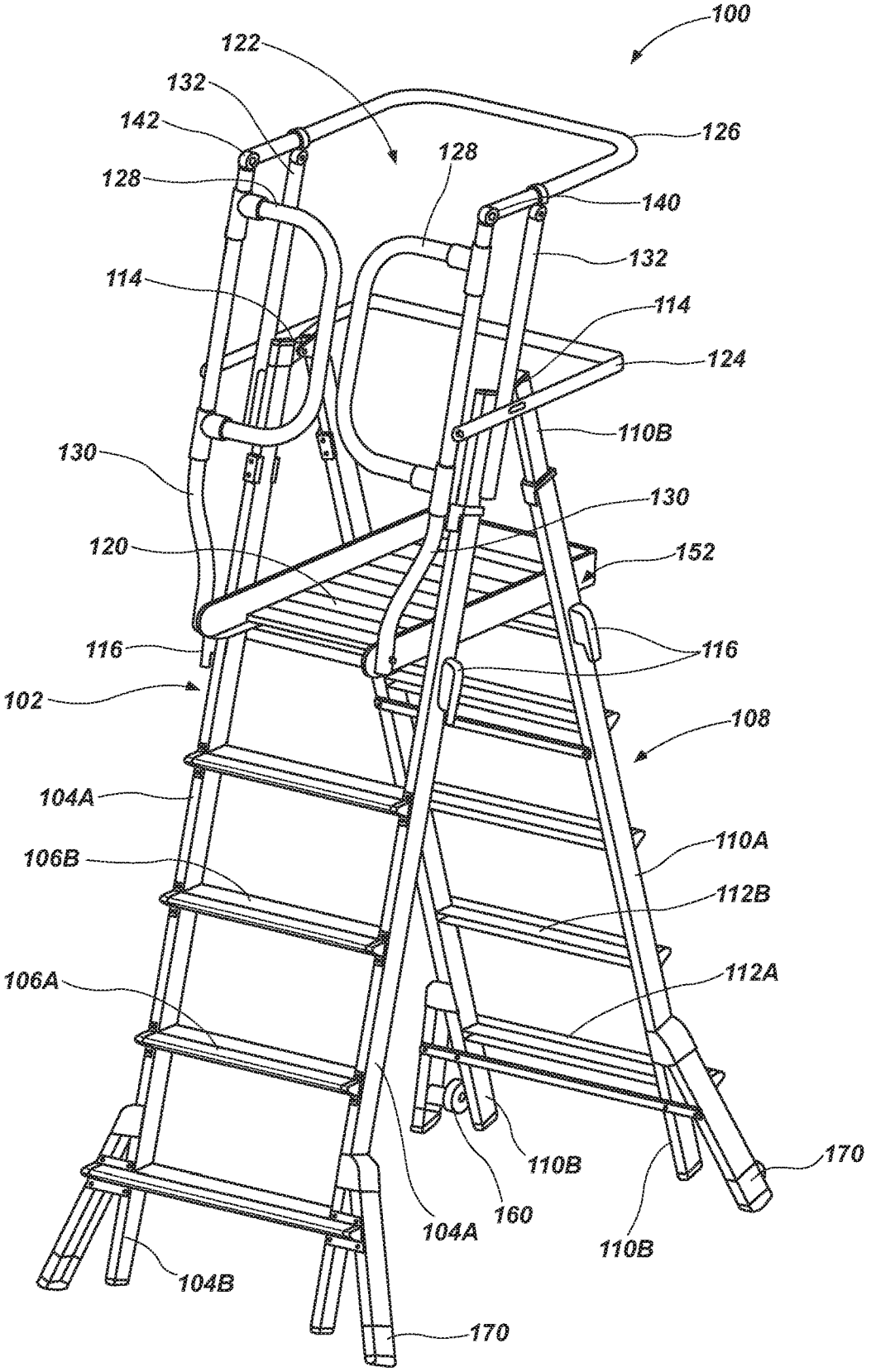
FIG. 1 shows an elevated platform apparatus in a closed or collapsed state in accordance with an embodiment of the present invention.
Figure 2:
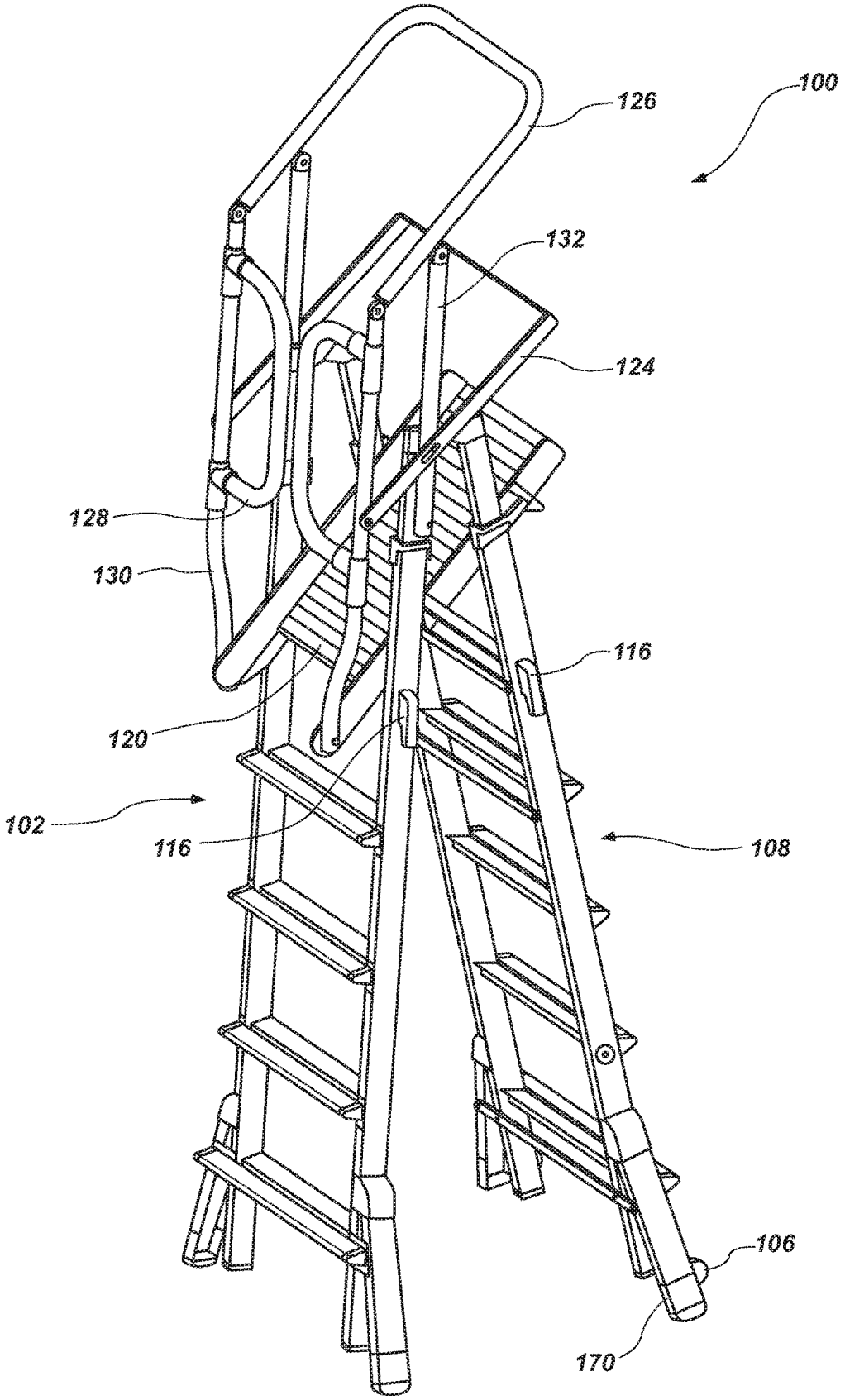
FIG. 2 shows the elevated platform apparatus of FIG. 1 in a partially closed or partially collapsed state in accordance with an embodiment of the present invention.
Figure 3:
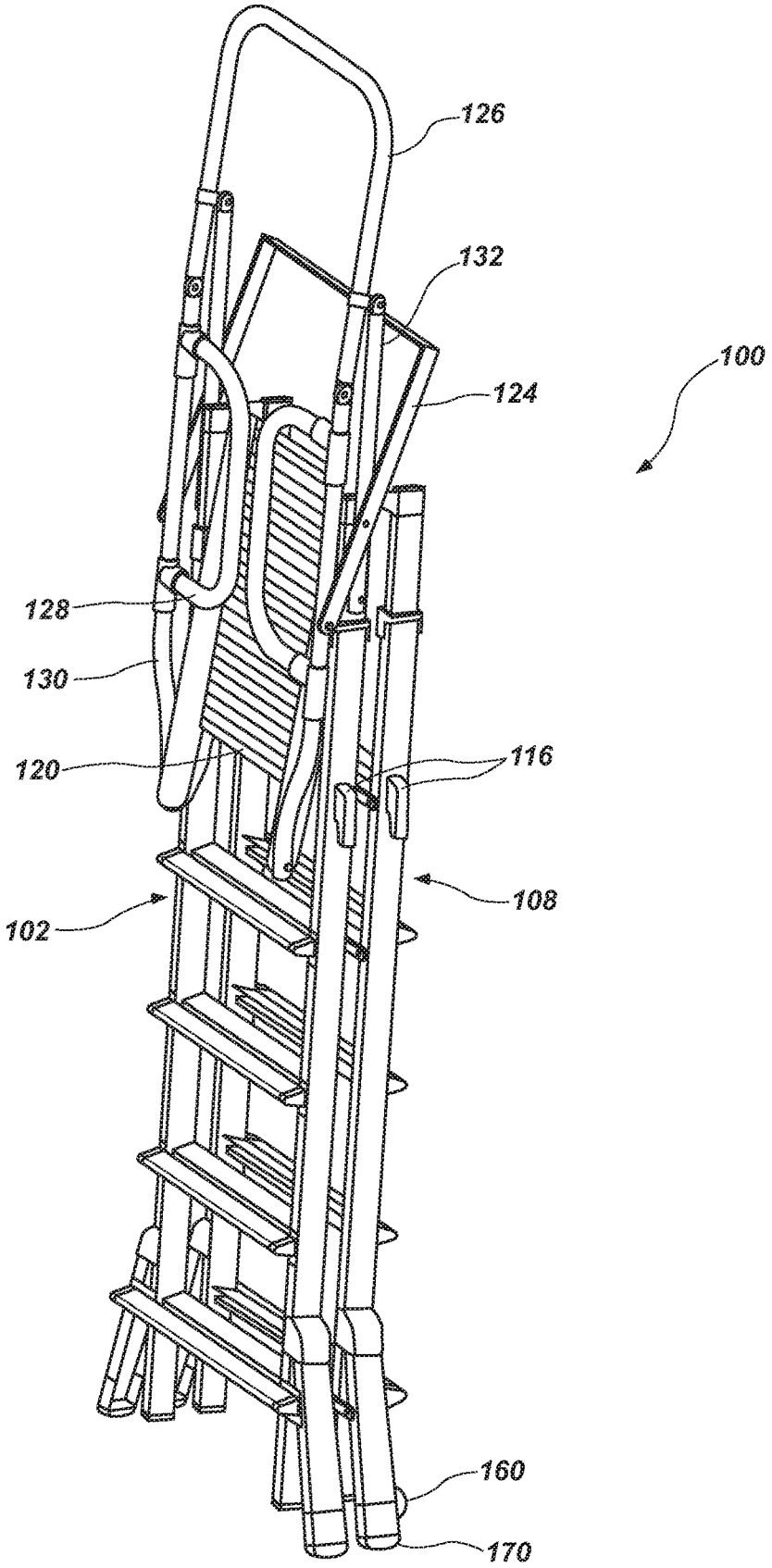
FIG. 3 shows the elevated platform apparatus of FIG. 1 in another partially closed or partially collapsed state in accordance with an embodiment of the present invention.

Referring to FIGS. 1-3, an elevated platform apparatus 100 is shown (referred to herein as the "apparatus" for purposes of convenience). The apparatus 100 includes a first assembly 102 having a first pair of spaced apart rails 104A with a plurality of rungs 106A extending between, and coupled to, the rails 104A. The rungs 106A are substantially evenly spaced, parallel to one another, and are configured to be substantially level when the apparatus 100 is in an orientation for intended use, so that they may be used as "steps" for a user to ascend (or descend) the apparatus 100. The first pair of rails 104A and their associated rungs 106A may be referred to as an outer rail assembly. The first assembly 102 may further include a second pair of spaced apart rails 104B with a plurality of rungs 106B extending between, and coupled to, the rails 104B. Again, the rungs 106B are evenly spaced, parallel to one another, and are configured to be substantially level when the apparatus 100 is in an orientation for intended use so that they, too, may be used as steps for a user to ascend (or descend) the apparatus 100. The second pair of rails 104B and their associated rungs 106B may be referred to as an inner rail assembly. The inner rail assembly is slidably coupled with the outer rail assembly such that the overall height of the assembly 102 may be selectively adjusted by a user. When the first assembly 102 is in a generally contracted state (exhibiting a shorter height), at least some of the rungs 106B of the inner rail assembly are adjacent to, and aligned with, at least some of the rungs 106A of the outer rail assembly. Thus, a rung 106A from the outer rail assembly and an aligned rung 106B from the inner rail assembly may cooperatively form a common "step" when a user is ascending or descending the apparatus 100 with the first assembly 102 in such a contract stated. On the other hand, when the first assembly 102 is in an extended state (exhibiting a relatively taller height), one or more of the rungs 106B of the inner rail assembly may be displaced upwardly from rungs 106A of the outer rail assembly, acting as their own, independent step, effectively providing more steps for a user to ascend.

The apparatus 100 also includes a second assembly 108 that may be configured similarly to the first assembly. For example, the second assembly 108 may include a first pair of spaced apart rails 110A with a plurality of rungs 112A extending between, and coupled to, the spaced apart rails 110A. The first pair of rails 110A and their associated rungs 112A may be referred to as an outer rail assembly. The second assembly 108 may further include a second pair of spaced apart rails 110B and a plurality of rungs 112B extending between, and coupled to, the rails 112B. The second pair of rails 110B and their associated rungs 112B may be referred to as an inner rail assembly. As with the first assembly 102, the inner rail assembly of the second assembly 108 is slidably coupled with the outer rail assembly of the second assembly 108 such that the overall height of the assembly 108 may be selectively adjusted by a user. In some embodiments, rather than rungs 114A and 112B, bracing or other structural components may be used to couple associated rail pairs (110A or 110B) and provide a desired level of support and strength to the spaced apart rails 110 of the second assembly.

The first and second assemblies 102 and 108 may be formed of a variety of materials and using a variety of manufacturing techniques. For example, in one embodiment, the rails 104A, 104B, 110A and 110B may be formed of a composite material, such as fiberglass, while the rungs and other structural components nay be formed of aluminum or an aluminum alloy. In other embodiments, the assemblies 102 and 108 (and their various components) may be formed of other materials including other composite materials, plastics, polymers, metals, metal alloys or combinations of such materials. Additionally, in one embodiment, the rungs may be coupled with their associated rails in a manner such as described in U.S. Pat. No. 7,086,499 entitled LIGHT WEIGHT LADDER SYSTEMS AND METHODS, the disclosure of which is incorporated by reference herein in its entirety.

The assemblies 102 and 108 may be coupled to one another by way of a pair of hinges 114 enabling them to extend into a deployed condition (FIG. 1) where they are positioned such that their lower ends are spaced apart from one another (creating a stable base for the apparatus 100), and collapse into a stowed condition where their lower ends are positioned relatively close to one another (FIG. 3—with FIG. 2 showing a transition between the states or conditions shown in FIGS. 1 and 3). As noted above, the first and second assemblies 102 and 108 may be independently adjustable such that they each may extend to varying elevations enabling the overall height of the apparatus to be selectively adjusted. Such assemblies 102 and 108 may be constructed, for example, as described in U.S. Pat. No. 4,182,431, entitled COMBINATION EXTENSIONS AND STEP LADDER RUNGS THEREFOR, the disclosure of which is incorporated by reference herein in its entirety.

Adjustment mechanisms 116 may be associated with either or both of the assemblies 102 and 108 to enable elevation or height adjustment of such assemblies. The adjustment mechanism 116 may be similar to that described in the aforementioned U.S. Pat. No. 4,182,431, or it may be of a different configuration. Another example of an adjustment mechanism (such as is depicted in FIGS. 1-3) is described in U.S. Patent Application Publication No. 2009/0229918 (U.S. application Ser. No. 12/399,815) entitled LADDERS, LADDER COMPONENTS AND RELATED METHODS, the disclosure of which is incorporated by reference herein in its entirety.

A platform or deck 120 is associated with the rail assemblies 102 and 108 and may rest on the uppermost rungs, or other associated structure, of the assemblies 102 and 108 when the apparatus 100 is in a deployed condition (see FIG. 1). In the embodiment shown in FIGS. 1-3, the platform is rotatably coupled with the first assembly 102 (e.g., with the pair of rails 104B of the inner rail assembly) and selectively engages the second assembly 108 to lock the platform 120 in a working position as shown in FIG. 1. When in the working or deployed state, the platform 120 provides an enlarged area or support surface for a worker to stand on comfortably and safely so that they can work at the highest support position of the apparatus 100.

A safety enclosure, referred to herein as a cage 122, may be formed about the platform to encompass a worker while standing on the platform 120. When designed appropriately, the provision of a cage may preclude the necessity of a worker needing to wear a harness and "tie off" while working on the apparatus. The cage 122 may include a first bar 124 positioned at a first elevation that extends around most (e.g., three sides) of the perimeter of the work space defined by the platform 120. The cage 122 may also include a second bar 126 positioned at a second (higher) elevation that extends around most of the perimeter of the work space defined by the platform 120. One or more gates 128 may be located on one side of the cage 122 and configured to enable a user to climb the first assembly 102 and pass through the gates 128 with the gates 128 closing behind the user as he or she stands on the platform 120, A number of components of the cage 122 may be coupled together using hinges or pivoting joints enabling them to be deployed, as shown in FIG. 1, and collapsed as indicated in FIGS. 2 and 3. For example, the bars 124 and 126 may be pivotally or hingedly coupled with extensions 132 coupled with the first assembly 102, or may be coupled to rails (e.g., rails 104A) of the first assembly 102. Similarly, the bars 124 and 126 may be pivotally coupled relative to the gate members 128.

The gates 128 may be configured, for example, to swing or pivot inwardly as the user pass through them from the rungs 106 of the first assembly 102 to the platform 120, automatically swing back to the position shown in FIG. 1 (through the use of springs or other biasing mechanisms or actuators), and then resist any force applied to it in an outward direction to prevent a user from inadvertently stepping back through the gates 128 and falling from the platform 120. A user may pull the gates 128 inwardly and pass through them from the platform 120 to the rungs of the first assembly 102 to exit the cage 122 and descend from the platform 120.

Figure 4:
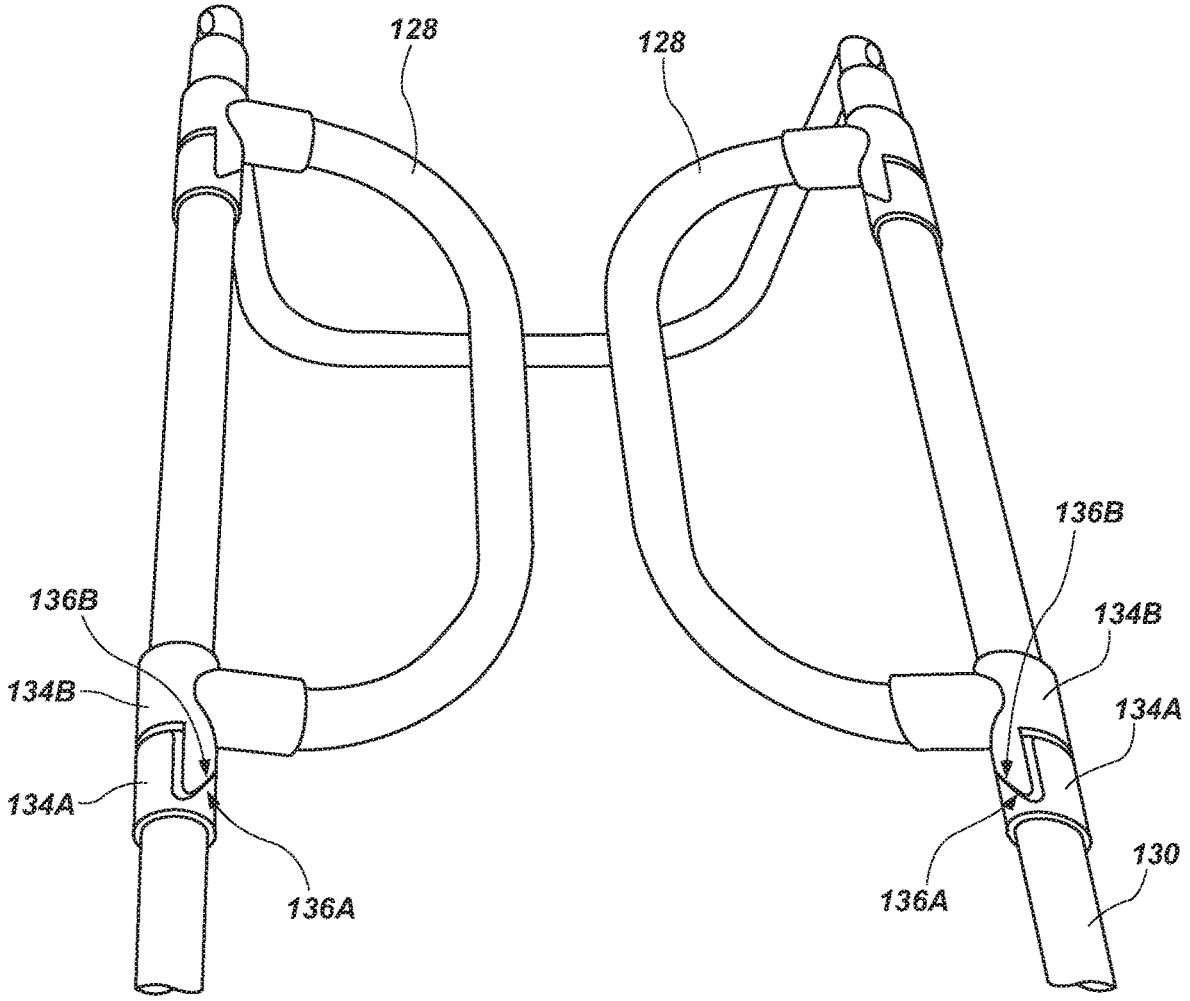
FIG. 4 shows additional details of certain components of the elevated platform apparatus shown in FIG. 1.

Referring briefly to FIG. 4, an example is shown of self returning gates 128 according to one embodiment of the invention which largely uses gravity to bias the gates into the closed position (i.e., the position shown in FIG. 1). Each of the gates 128 are rotatably coupled with an associated post member 130 positioned adjacent to an extension member 132 projecting from the first assembly 102. One or more of the connections between the gates 128 and their associated post member 130 may include a pair of collars 134A and 134B. The pair of collars 134A and 134B may each include mating inclined engagement surfaces 136A and 136B. When the gates 128 are rotated inwardly (i.e., as a user pushes the gates 128 to pass through onto the platform 120), the rotation of the upper collar 134A relative to the lower collar 134B causes the upper collar 134A (and the associated gate 128) to be displaced slightly upwardly (relative to the lower collar 134B). With the upper collar 134A in the rotated position (i.e., with the gate 128 opened inwardly), the weight of the gate 128 pushes down through the inclined surface 136A of the upper collar 134A on to the inclined surface 136B of the lower collar 134B causing the gate 128 and upper collar 134A to rotate back to their "closed" position. Of course, other mechanisms may be used in place of, or in addition to, that shown in FIG. 5 to bias the gates 128 to their closed positions.

Returning to FIGS. 1-3, the upper bar 126 may be positioned at a height, for example, that is between the waist height and the chest height of an average user (e.g., between approximately 3 feet and 5 feet above the platform 120). In one embodiment, the height of the upper bar 126 (as well as the lower bar(s) 124) may be adjustable to accommodate users of varying heights. In such a case, a minimum height may be defined per relevant safety standards or in accordance with appropriate design considerations. Additionally, in one embodiment, either or both of the bars 124 and 126 may be enlarged relative to the perimeter of the platform 120 such that the volume defined by the cage is larger than just the volume that would be defined by the perimeter of the platform 122 extended upwards. In other words, while a user may be able to stand on a relatively small surface area, the rest of the user's body may need more space to move about, especially if the user is wearing a tool belt or carrying other equipment needed to accomplish their task.

Stated another way, the perimeter of the upper portion of the cage 122 (such as may be defined by tracing a path starting at a first end 140 of the upper bar 126, following the upper bar 126 around to its second end 142, and then across the gates 128 back to the first end 140 of the upper bar 126) is larger than the perimeter of the platform 120. Similarly, the area bound by the perimeter of the upper portion of the cage 122 in such an embodiment is larger than the area that is bound by the perimeter of the platform 120.

The upper bar 126 may be pivotally coupled to the extension members 132 extending from the rails 104 of the first assembly 102 above the hinges 114. It is noted that the extension members 132 may be integral with the associated rails 104 (e.g., with the rails 104A of the inner rail assembly), or they may be separate members coupled with the rails through appropriate means. The lower bar 124 may be pivotally coupled to the extension members 132 or it may be coupled to the rails 104 depending on the height of the bar 124 relative to the platform 120.

Figure 5:
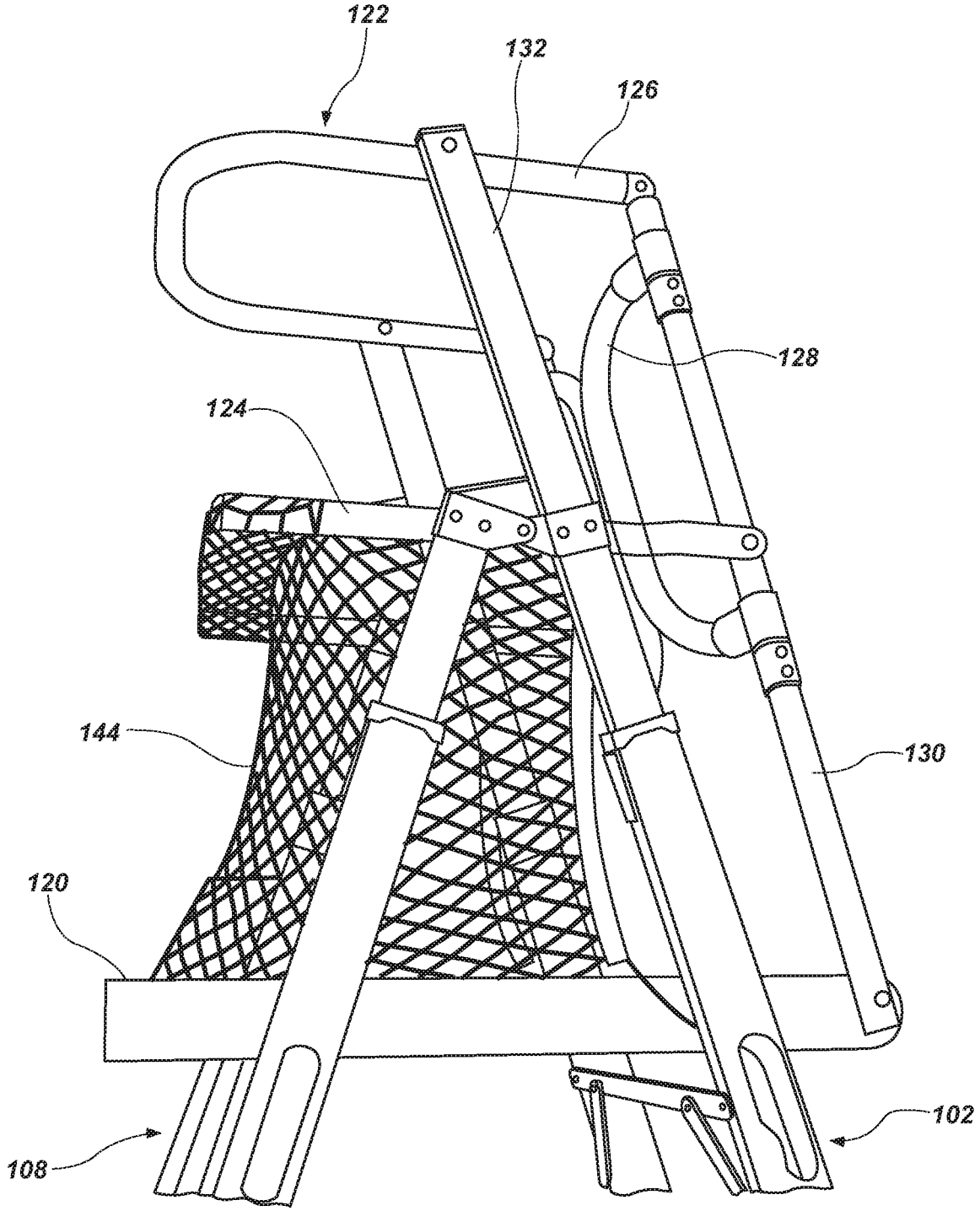
FIG. 5 shows further details of additional components of the elevated platform apparatus shown in FIG. 1.
Figure 6:
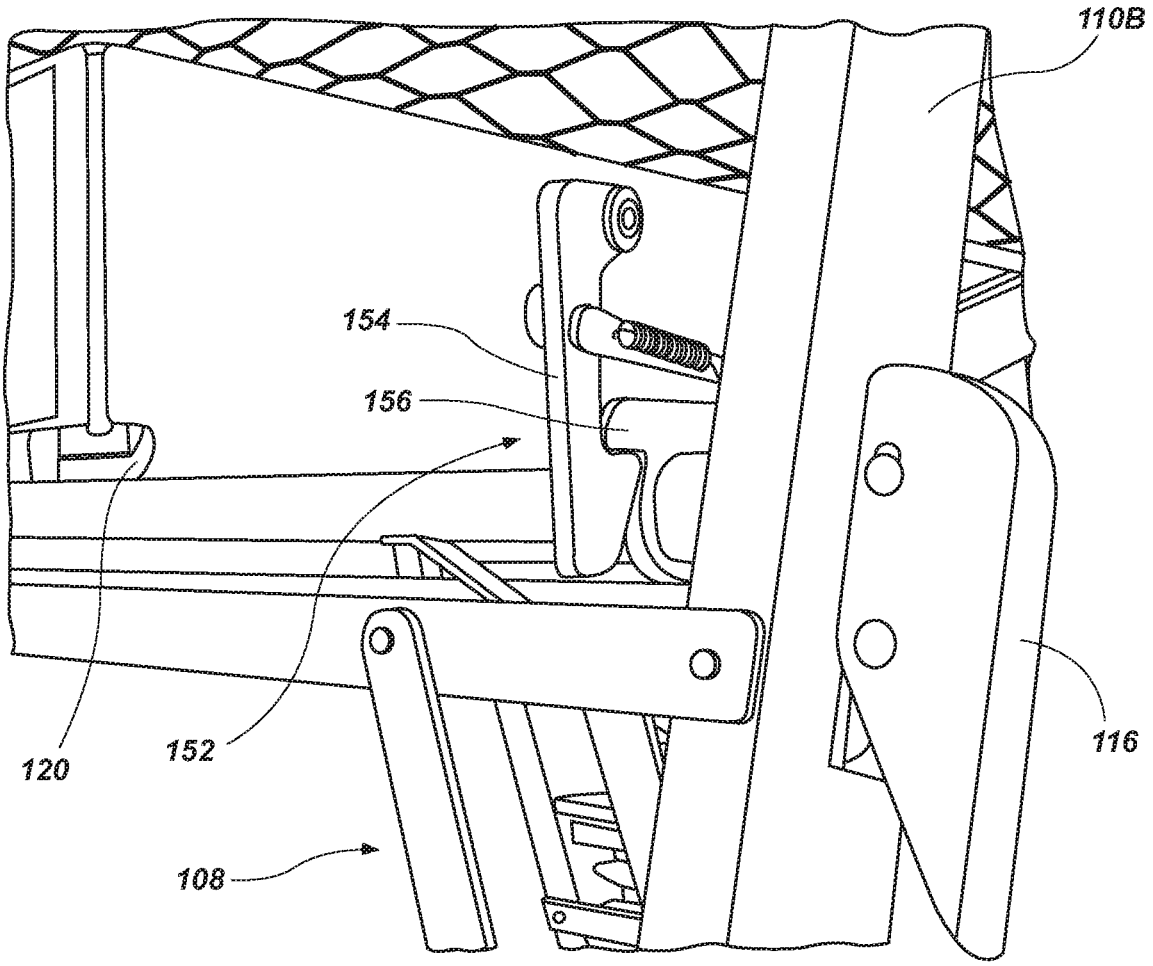
FIG. 6 shows details of further components of the elevated platform apparatus shown in FIG. 1.

As may be seen in FIG. 5, the cage 122 may include netting or other components to form a flexible barrier 144 about at least a portion of the perimeter of the cage 122 to further confine a user within the cage 122. For example, as shown in FIG. 6, the flexible barrier 144 may include netting extending generally between the platform 120 and the lower bar 124 and may extend about the sides of the cage 122 while not impeding the entrance through the gates 128. The flexible barrier may provide additional security in preventing a user from placing a foot or leg through the space defined between the platform 120 and the lower bar 124. If desired, such a flexible barrier 144 may be extended further, for example, up to the upper bar 126.

Referring to FIG. 6, a lock 152 may be associated with the platform 120 such that when the apparatus 100 is deployed (in the condition shown in FIG. 1), the platform 120 is secured in place and the apparatus is in a stable condition with the assemblies fixed in relative position to one another. A pair of locks 152 may be used with one being positioned on each side of the platform 120, preventing it from folding into a collapsed state until both locks 152 are independently actuated by a user. In the embodiment shown, the locks 152 include a lever 154 that is rotatably coupled with the platform 120 and biased into catching- or locking-engagement with a shoulder 156 or other protrusion associated with the second assembly 108 (e.g., by way a spring or other biasing member). Application of force to the lever 154 of the lock 152 by a user can overcome the biasing force such that the lock or locks 152 disengage the shoulder 156 and enable the platform 120 to rotate upwards and into a collapsed state such as shown in FIGS. 2 and 3.

The apparatus 100 may further include wheels 160 associated with either or both of the assemblies 102 and 108. In one embodiment, as seen in FIGS. 1-3, a first set of wheels 160 may be coupled with the second assembly 108 at a fixed location and be configured such that they do not touch the ground when the apparatus 100 is in a deployed condition as shown in FIG. 1, but are configured to engage the ground when the apparatus is collapsed (FIG. 3) and then tilted beyond a given angle. This enables the wheels 160 to be used to rolling the apparatus (e.g., such as by being dragged by a user) when in a collapsed state, while preventing the apparatus 100 from rolling on the wheels 160 when it is in a deployed condition.

Feet 170 may be coupled to the bottom of the rails and have appropriate engagement surfaces associated therewith to provide the apparatus 100 with the desired friction and stability when placed on a supporting surface. In one embodiment, the feet 170 may be configured to "snap-on" to the associated rail. For example, the feet 170 (or a combination of the feet and the wheels 160) may be manufactured and assembled as described in U.S. Provisional Patent Application No. 61/445,387 entitled LADDERS, LADDER COMPONENTS AND RELATED METHODS, the disclosure of which is incorporated by reference herein in its entirety.

Figure 7:
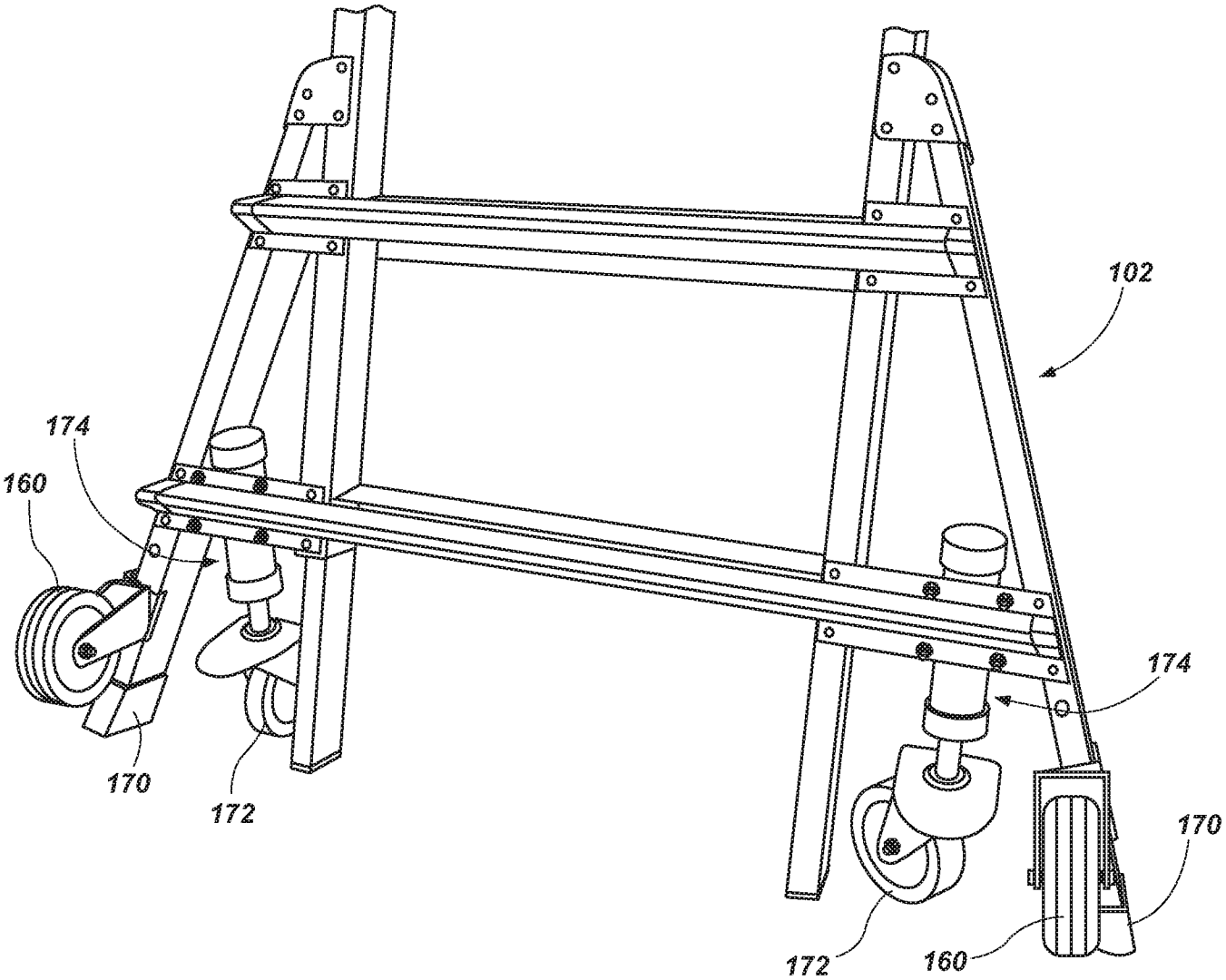
FIG. 7 shows an enlarged portion of an elevated platform apparatus depicting additional components and mechanisms that may be used in accordance with an embodiment of the invention.

In another embodiment, retractable wheels 172 may be associated the first assembly 102, the second assembly 108 or both, in place of, or in addition to, the wheels 160 discussed above. For example, as shown in FIG. 7, retractable wheels 172 may be coupled to the first assembly 102 (in addition to fixed location wheels 160 such as described above). While specifically shown in association with the first assembly 102 in FIG. 8, a first pair of retractable wheels 172 may be coupled to the first assembly 102 and a second pair of retractable wheels 172 may be coupled with the second assembly. When in a deployed state, the retractable wheels 172 may engage the ground or other supporting surface such that the first and second assemblies 102 and 108 are lifted above the ground and the apparatus 100 may be maneuvered from one location to another by rolling it about on the retractable wheels 172. Once the apparatus is in a desired position on a supporting surface, the retractable wheels 172 may be retracted to a stored state so that the feet 170 of the apparatus may rest securely on the ground or other supporting surface.

In one embodiment, each of the retractable wheels 172 (e.g., four, with two being associated with each assembly 102 and 108) may be capable of independent actuation rather than relying on a single mechanism to deploy or retract the set of wheels simultaneously. Such may help to prevent the inadvertent deployment of wheels during use of the apparatus 100, since independent actuation would require a more affirmative act.

Various types of actuating mechanisms may be used for deploying and retracting the wheels 172. For example, in one embodiment, the wheels 172 may be constructed with a biasing element that, when subjected only to the weight of the apparatus 100, enables the wheels to be deployed such that the apparatus may be rolled from one position to another, while, when a user climbs onto the apparatus 100, the additional weight of the user causes the wheels 172 to retract so that the feet 170 engage the ground and stabilize the apparatus 100.

In another embodiment, the retractable wheels 172 may include a cam-follower retraction mechanism similar to what is found in many retractable ball-point pens. For example, referring to FIG. 8, an exploded view of a retraction mechanism 174 is shown. The mechanism 174 includes a housing 176, a cam sleeve 178 having a plurality of axially extending slots 180 circumferentially disposed about an interior surface thereof and formed between a plurality of cam features 182 having angled engagement surfaces 184 formed at their lower ends. The mechanism further includes a push rod 186 having an undulating engagement surface 188 and a plurality of fins 190 as well as a cam follower 192 having a plurality of fins 194, with each fin 194 having an angled engagement surface 196. The mechanism 174 further includes one or more springs 198, end caps 200, a mounting plate 202 for mounting to the wheel 172 or caster, and a plurality fasters 204 to couple the various components together in a desired configuration.

The fins 190 of the push rod 186 are positioned within corresponding slots 180 of the cam sleeve 178 such that the push rod 186 may be axially displaced within the cam sleeve 178 along an longitudinal axis but not rotate within the cam sleeve about the longitudinal axis. The cam follower 192 is configured so that its engagement surfaces 196 engage the undulating engagement surface 188 of the push rod 186 and selectively engage the engagement surfaces 184 of the cam features 182. When not engaged with the engagement surfaces 184 of the cam features 182, the fins 194 of the follower are disposed within the slots 180 so that the follower may be displaced upwardly within the cam sleeve 178.

In operation, a user may lift up on a corner of the apparatus (e.g., so that a foot 170 adjacent the retractable wheel 172 is displaced off of the ground) and push down on the mounting plate 202. Assuming that the mechanism 174 is in a retracted state with the wheel or caster displaced upwards), this causes the fins 194 of the cam follower 192 to disengage the slots 180 of the cam sleeve 178 while the undulating surface 188 of the push rod 190 effects a rotation of the cam follower 192 such that when the user removes their foot (i.e., removes application of force to the lower portion of the mechanism 174), the spring 198 pushes the cam follower 192 upwards causing its engagement surfaces 196 to abut the engagement surfaces 184 of the cam features 182. This places the cam follower 192, push rod 186 and, ultimately the wheel 172 or caster in a lower axial position relative to the cam sleeve 178 and housing 178 such that the wheel is "deployed" and may engage the ground instead of the foot 170 that is adjacent the retractable wheel 172. Pushing down on the mounting plate 202 again causes the cam follower 192 to disengage the cam features 182 and enables it to return to its prior axial position with the fins 194 disposed within slots 180 of the cam sleeve 178, placing the Wheel in a retracted position. Thus, each retractable wheel 172 may be independently, selectively actuated as noted above. With all of the retractable wheels 172 in a deployed state, the apparatus 100 may be easily wheeled to a new location while maintaining the entire apparatus in a deployed state (i.e., in the state shown in FIG. 1) without collapsing the apparatus the state shown in FIG. 3). When the apparatus 100 is in a desired location, the user may retract each wheel 172 such that all of the feet 170 rest on the ground or other supporting surface.

Figure 8:
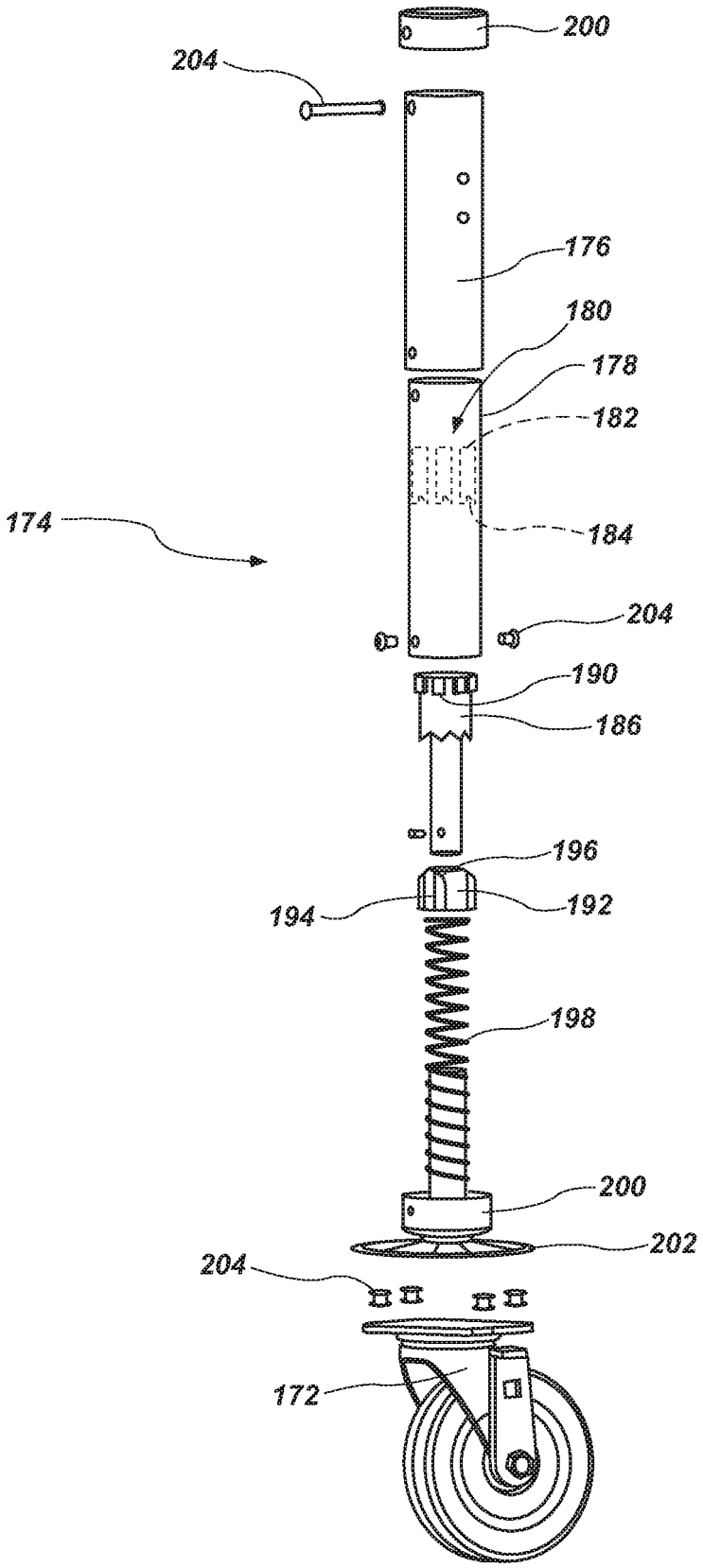
FIG. 8 shows an exploded view of a mechanism shown in FIG. 7 according to an embodiment of the invention.

It is noted that various combinations of actuators or mechanisms may be used and that all of the retractable wheels 172 need not use the same type of mechanism. For example, a mechanism such as shown in FIG. 8 may be used with the retractable wheels 172 associated with the first assembly 102 while other mechanisms (e.g., those that deploy and retract based on applied weight, as described above) may be used with the retractable Wheels 172 associated with the second assembly 108. Additionally, as previously noted, the retractable wheels 172 need not replace the wheels 160 that are placed in a fixed location on one of the assemblies (i.e., 102 or 108). Instead, the apparatus 100 may include, for example, a total of six or more wheels with two or more wheels used for transporting the apparatus 100 when in a collapsed state (i.e., wheels 160) and four or more wheels for selective deployments and retraction that may be used to maneuver the apparatus 100 when it is in a deployed or "in-use" state (i.e., retractable wheels 172).

Figure 9:
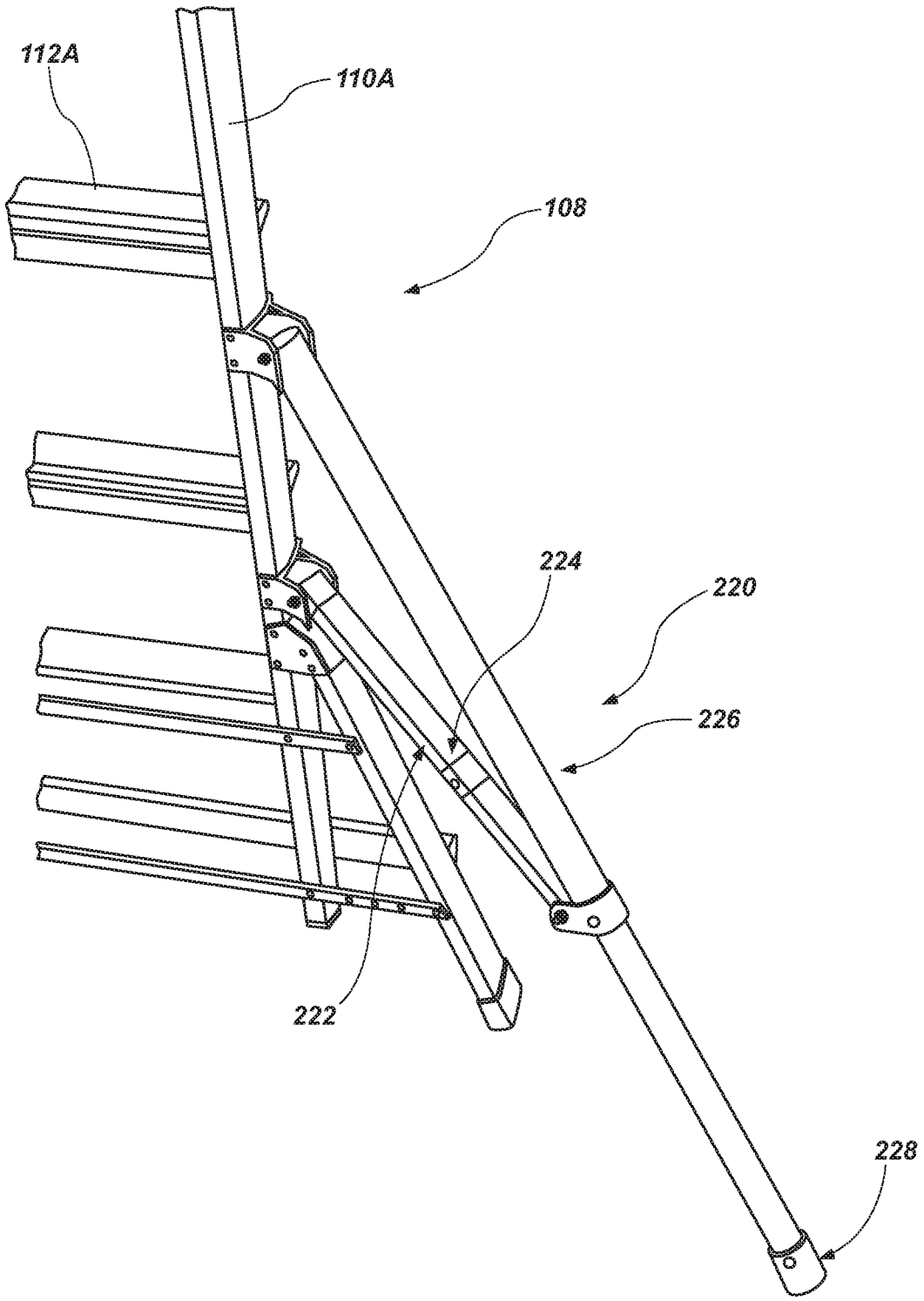
FIG. 9 shows an enlarged view of a portion of an elevated platform apparatus depicting various components and mechanisms to an embodiment of the invention.

Another feature that may also be included with the apparatus 100 is a stabilizer mechanism. For example, stabilizers or outrigger mechanisms may be associated with the first assembly 102, the second assembly 108, or both, to provide a wider support base and provide greater stability to the apparatus 100. Such stabilizers may also enable the apparatus 100 to be placed in areas having relatively uneven ground wherein the stabilizers adjust to compensate for such unevenness. Referring briefly to FIG. 9, a stabilizer 220 is shown in association with a rail 110A of the second assembly 108 of an apparatus 100. The stabilizer 220 includes a first swinging arm 222 having one end pivotally coupled with the rail 110A and having an adjustment mechanism 224 that enables the length of the swing arm 222 to be selectively adjusted. For example, the swinging arm 222 may include tubular members (of circular or polygonal cross shape) with one being telescopingly disposed within the other. The adjustment mechanism 224 may include a locking pin or detent mechanism to enable the selective locking of the two tubular members at one or more desired positions relative to each other. The second end of the first swinging arm 222 is pivotally coupled to a second swinging arm 226. The second swing arm 226 has a first end pivotally coupled with the rail 110A at a location spaced from the connection of the first swinging arm 222. The second swinging arm 226 is also adjustable in length with a foot 228 or traction member disposed at its lower end for engaging the ground or other support surface. In one embodiment, the second swinging arm 226 may include two tubular members with one being telescopingly disposed within the other. The second swinging arm may further include a mechanism to enable the selective adjustment of such tubular arms relative to each other. For example, as will be appreciated by those of ordinal skill in the art, a mechanism may be used so that rotation of the lower tubular member relative to the upper tubular member in one direction "locks" the two members relative to each other, while rotation in the other direction "unlocks" the members and enables the lower tubular member to slide in and out of the upper tubular member to adjust the overall length of the swinging arm 226. Such a configuration enables the adjustment of the second swinging arm to be non-incremental (i.e., allowing any length of the second swinging arm between a defined maximum and a defined minimum).

While a single stabilizer 220 is shown in FIG. 9, it will be understood that a second stabilizer may be coupled with the corresponding rail, of the pair of rails 110B, for the second assembly 108. Additionally, while shown in association with the second assembly 108, such a stabilizer mechanism may be used in association with the first assembly 102, or in association with both the first assembly 102 and the second assembly 108.

Figure 10A:
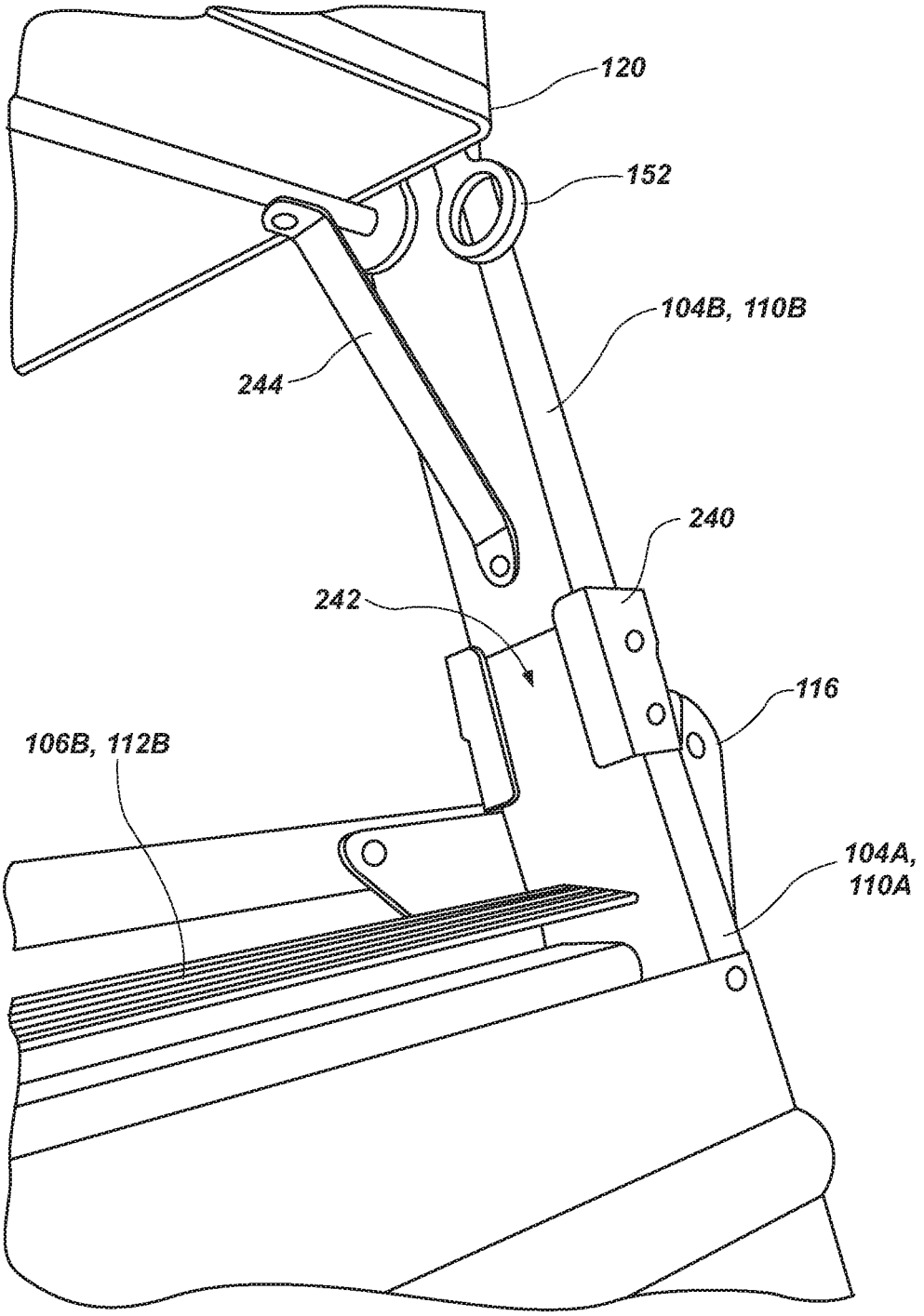
FIGS. 10A and 10B show a reverse perspective view and a side view of a component of the elevated platform apparatus shown in FIG. 1.
Figure 10B:
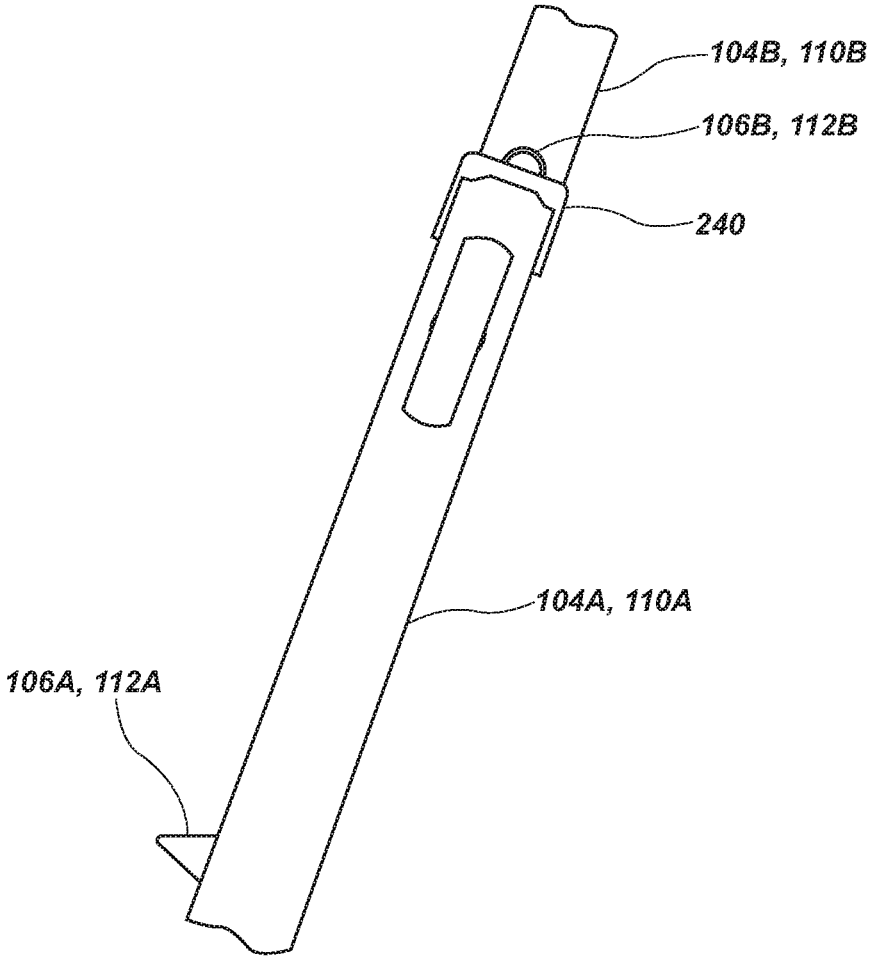

Referring now to FIGS. 10A and 10B, a reinforcing bracket 240 is shown in accordance with an embodiment of the invention. The reinforcing bracket may be positioned on the upper ends of the external rails (104A and 110A) of the two assemblies (102 and 108). For purposes of simplicity, reference will be made to rail 104A in the following description. The bracket 240 may wrap around all four corners of the rail 104A. However, the bracket 240 is discontinuous on the interior side of the rail 104A. Although discontinuous along the interior side, the bracket 240 wraps around the interior corners of the rail 104A and extends along an interior surface of the inner rails 104B, thus substantially circumscribing or "enclosing" the inner rail 104B within the bracket 240. The bracket 240 reinforces the upper portion of the rail 104A, which is generally formed as a C-channel shape, so that the upper end of the outer rail 104A does not splay or spread outward (away from engagement with the inner rail 104B) when a load is applied to the rail 104A during use of the apparatus 100 (including when a force is applied to the adjustment mechanism 116 used to adjust the height of an associated assembly). The discontinuous nature of the bracket 240 defines a slot 242 through which various components (e.g., inner rungs 106B, support brackets 244, etc.) may pass through when the inner rails 104B are slidingly displaced relative to the outer rails 104A to adjust the height of the assembly 102.

Figure 11A:
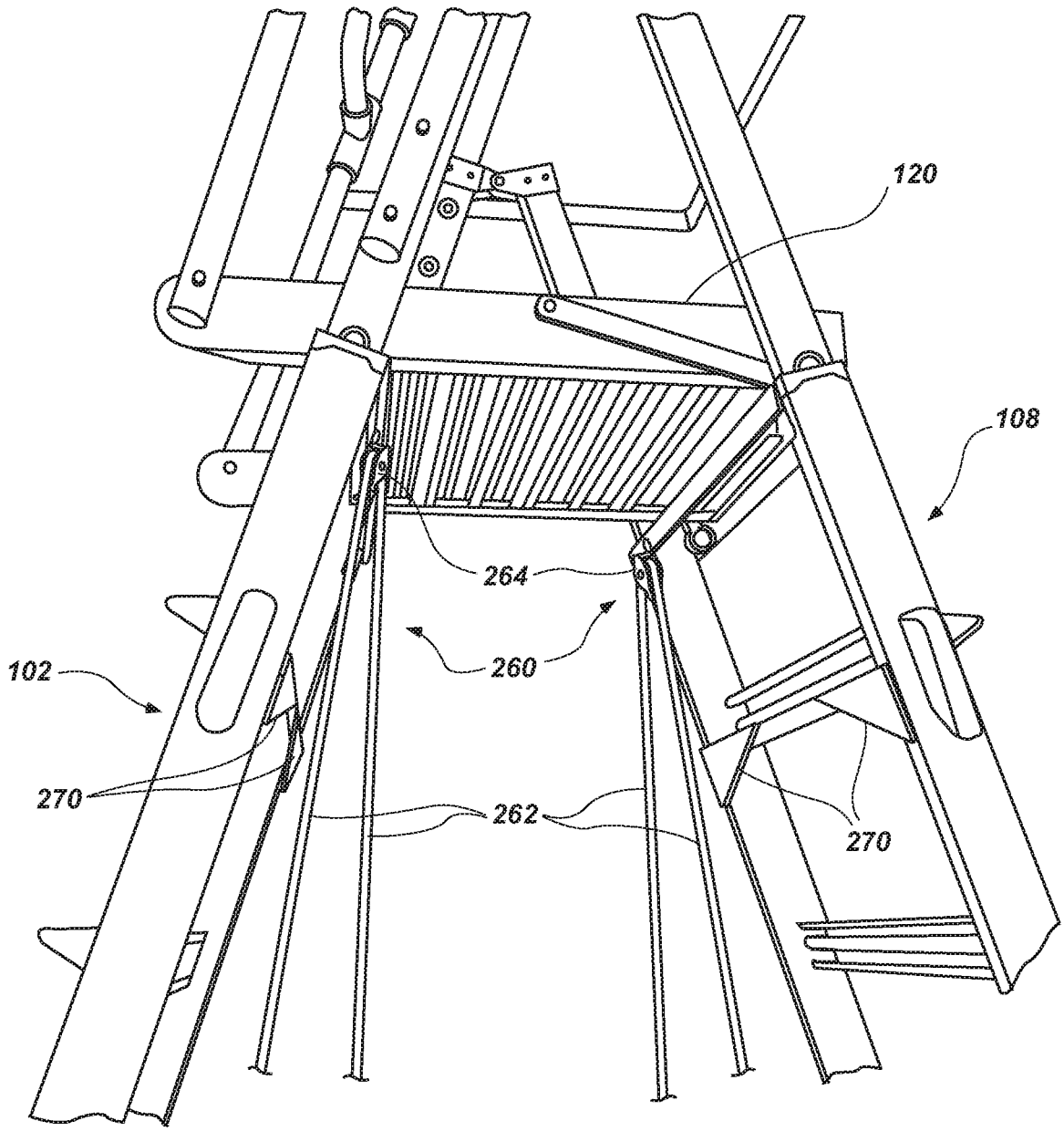
FIGS. 11A-11C show additional components incorporated into an elevated platform apparatus according to an embodiment of the invention.
Figure 11B:
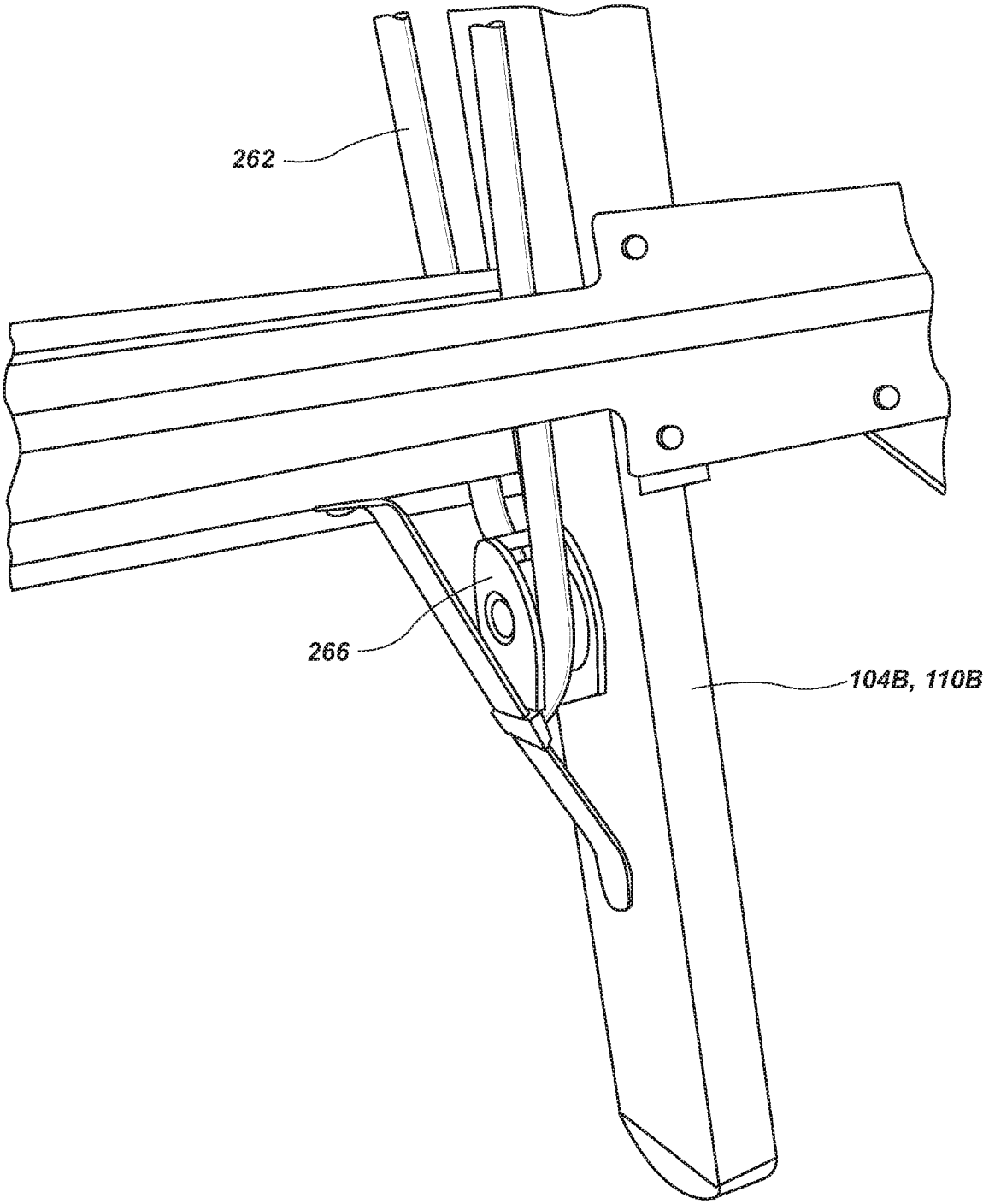
Figure 11C:
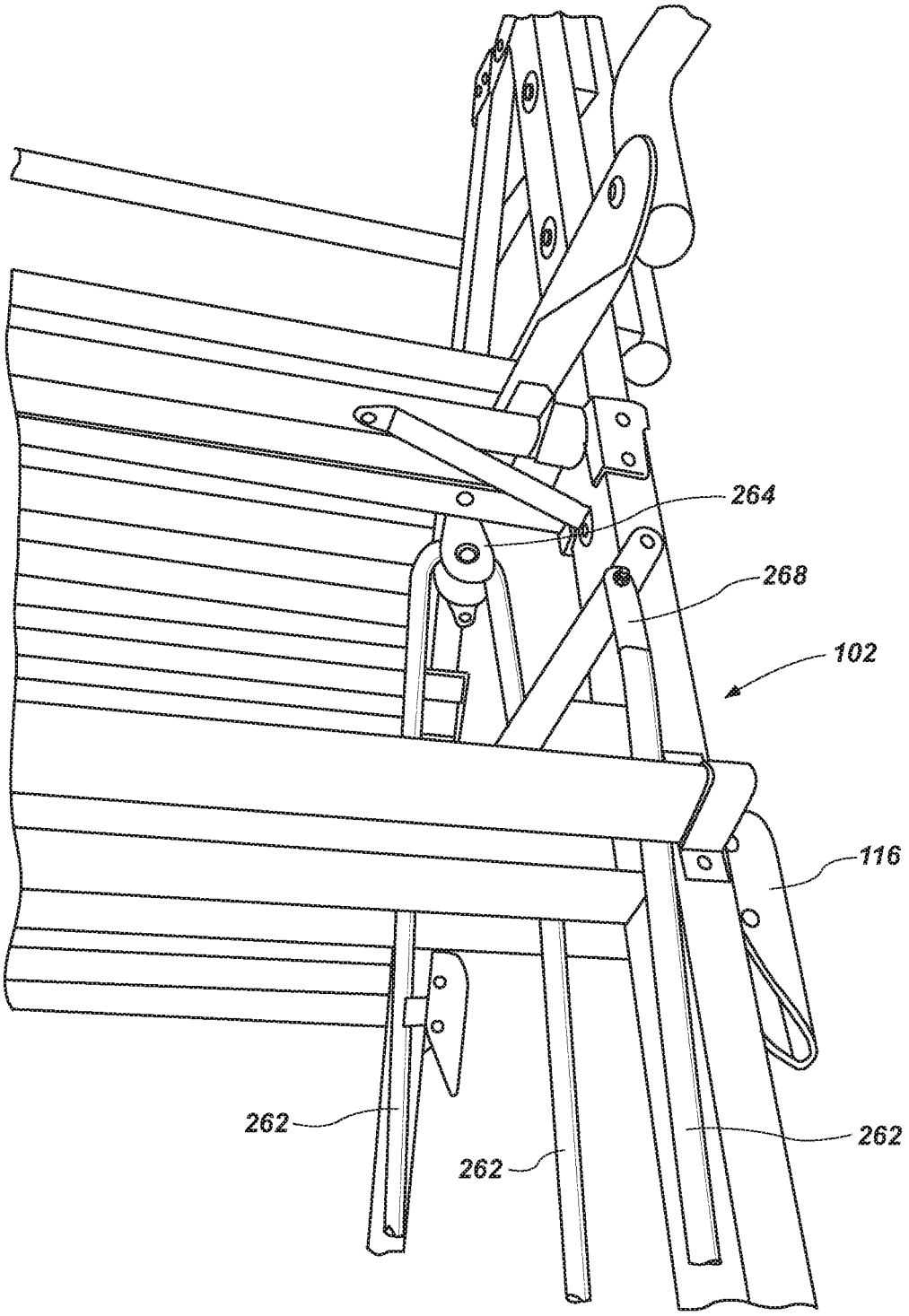

While the apparatus shown in FIG. 1 shows a certain number of outer rungs 106A and inner rungs 106B, it is noted that the present apparatus may be configured at a variety of heights, with any number of rungs (inner and outer). As such, in configurations where the assemblies 102 and 108 are relatively tall, and include numerous rungs, it may become difficult to adjust the inner rails (104B and 110B) relative to the outer rails (104A and 110B) due to their height and orientation. As such, one or more pulley systems, or other adjustment systems, may be used. For example, referring now to FIGS. 11A-11C, a pulley system 260 is shown in accordance with an embodiment of the invention. Each assembly 102 and 108 includes its own pulley system for independent selective adjustment of the assembly. As seen in FIGS. 11A and 11C, a given system 260 may include a rope 262, cable or other tension line fed through a first pulley 264 that is coupled with the outer rails (104A or 110A), a bracket or some other portion of the outer rail assembly. The rope 262 may be fed through a second pulley 266 which is coupled with an inner rail (104B or 110B) or to, bracket or other component associated with the inner rail assembly, as shown in FIG. 11B. One end of the rope 262 is coupled with an outer rail assembly (e.g., outer rails 104A or 110A) as indicated at 268 in FIG. 11C.

In operation, when it is desired to raise an assembly (e.g., 102) to an increased height, a user may actuate the adjustment mechanisms 116 associated with the assembly 102 to enable sliding displacement of the inner rails 104B relative to the outer rails 104A, and then pull the free end of the rope 262 (i.e., apply a tensile force to the rope 262 from the free end). This causes the rope to pull upward on the second pulley 266 causing the inner rails 104B (and associated rungs 106B and other components, including the platform 120 and cage 122 components) to be displaced upward relative to the outer rails 104A. Once at a desired height, the adjustment mechanisms 116 may again be actuated to lock the inner rails 104B relative to the outer rails 104A. A similar process may be used in adjusting the assembly to a lower height by allowing the free end of the rope 262 to slowly be displaced back through the first pulley 264 while keeping the rope 262 relatively taut.

Referring again to FIG. 11A, a bracket 270 may be coupled to each outer rail 104A and 110A adjacent the location of the adjustment mechanisms 116. Not only does the bracket help to provide structural support to the assemblies 102 and 108, but also serves as a safety barrier to prevent a user from pinching or smashing their fingers during use of the apparatus—specifically during actuation of the adjustment mechanisms 116. For example, when actuating an adjustment mechanism, a user may tend to place the palm of their hand on the lower portion of the lever of the adjustment mechanism 116, wrapping their fingers around the back side of the outer rail (104A or 110A) and along the interior side of the rails. If a user keeps their fingers in this position after actuating the adjustment mechanisms 116, their fingers may get caught or smashed by components associated with the inner rails 104B or 110B as they slide relative to the outer rails 104A and 110B (e.g., inner rungs 106B and 112B, brackets, etc.). The placement of the brackets 270 on the back side of the rails (i.e., the side facing the other assembly) at a location that is adjacent the adjustment mechanisms helps to prevent a user from wrapping their fingers around the outer rails 104A and 110A, eliminating, or at least reducing, the risk of potential injury to the user's hands.

Figure 12:
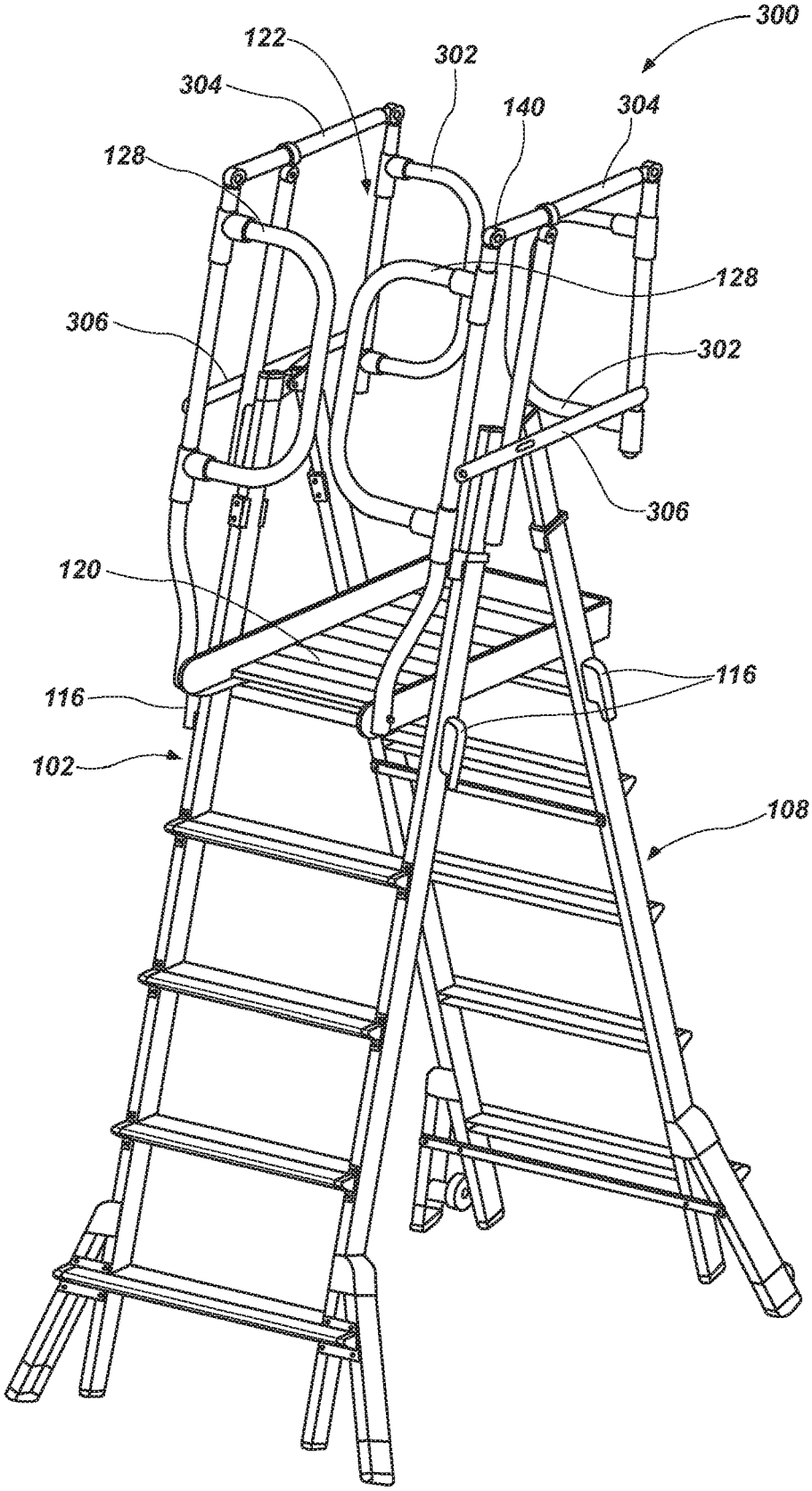
FIG. 12 shows an elevated platform apparatus in accordance with another embodiment of the invention.

Referring now to FIG. 12, another embodiment of an apparatus 300 is shown. The apparatus 300 is generally similar to the previously described apparatus 100, including a first assembly 102 and a second assembly 108, with their various components, as well as a platform 120. However, the apparatus 300 includes not only a first set of gates 128, but a second set of gates 302 on the opposing side of the platform 120. The second set of gates 302 may be pivotally coupled with various components of the cage 122 (e.g., the upper and lower bars 304 and 306) and may function similarly to the first set of gates 128 as described above. The second set of gates 302 enable a user to access the platform 120 of the apparatus 300 by climbing the rungs of either assembly 102 or 108, providing greater efficiency and functionality to a user of the apparatus 100.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. An elevated platform apparatus comprising:

a first assembly having first inner rail assembly slidably coupled with a first outer rail assembly;

a second assembly having a second inner rail assembly slidably coupled with a second outer rail assembly, the second assembly being hingedly coupled with the first assembly, the first assembly and the second assembly being selectively positionable relative to each other between a deployed state and a collapsed state;

a platform pivotally coupled with the first assembly and configured to extend between spaced apart portions of the first assembly and the second assembly when they are in the deployed state;

a cage including at least one frame member and at least one gate collectively forming a barrier substantially surrounding an area above the platform when the first and second assemblies are in the deployed state and when the at least one gate is in a closed position, the at least one gate being selectively positionable from a closed position to an open position wherein the at least one gate is rotated inwardly such that a portion of the at least one gate extends into the area surrounding the platform, and wherein the at least one gate is limited from rotating outwardly away from the area above the platform beyond the closed position;

at least one locking mechanism configured to selectively lock the first inner rail assembly at a specified location relative to first outer rail assembly; and at least one adjustment mechanism associated with the first assembly and configured to assist adjustment of the first inner rail assembly from a first position relative to the first outer rail assembly to a second position relative to the first outer rail assembly.

2. The apparatus of claim 1, wherein the at least one adjustment mechanism includes a rope and pulley system.

3. The apparatus of claim 1, further comprising at least one other locking mechanism configured to selectively lock the second inner rail assembly at a specified location relative to second outer rail assembly.

4. The apparatus of claim 1, wherein the first inner rail assembly includes a pair of spaced apart rails coupled with a plurality of rungs.

5. The apparatus of claim 4, wherein the first outer rail assembly includes an additional pair of spaced apart rails coupled with an additional plurality of rungs.

6. The apparatus of claim 1, wherein, when the first assembly and the second assembly are in the collapsed state, the platform is positioned adjacent the at least one gate.

7. The apparatus of claim 1, wherein the at least one gate includes a pair of gates.

8. The apparatus of claim 1, further comprising a locking member configured to releasably lock the platform with the second assembly when the first and second assemblies are in the deployed state.

9. The apparatus of claim 1, wherein the at least one gate is biased towards the closed position.

10. The apparatus of claim 1, further comprising at least one pair of wheels coupled with the apparatus.

11. The apparatus of claim 10, wherein the at least one pair of wheels includes:

a first pair of wheels coupled with at least one of the first assembly and the second assembly at a fixed location;

a second pair of wheels coupled with the first assembly, the second pair of wheels including at least one retraction mechanism;

a third pair of wheels coupled with the second assembly, the third pair of wheels including at least one retraction mechanism.

12. The apparatus of claim 11, wherein the first pair of wheels are positioned such that they do not contact a supporting surface when the apparatus is positioned on the supporting surface in a deployed state and in an orientation of intended use.

13. The apparatus of claim 1, wherein the at least one frame member includes a first frame member and a second frame member.

14. The apparatus of claim 12, wherein the first frame member is positioned at a first height above the platform when the first and second assemblies are in the deployed position and wherein the second frame member is positioned at a second height above the platform when the first and second assemblies are in the deployed position, the second height being greater than the first height.

15. The apparatus of claim 13, further comprising a flexible material extending upward from the platform to at least the first frame member.

16. The apparatus of claim 1, further comprising at least one adjustable stabilizer coupled with at least one of the first rail assembly and the second rail assembly.

* * * * *